US005833587A

United States Patent [19]

Strong et al.

[11] Patent Number: 5,833,587

[45] Date of Patent: Nov. 10, 1998

[54] APPARATUS AND METHOD FOR EXERCISING

[75] Inventors: Patrick Strong, Marina Del Rey; Kenneth Edward Barton, Santa Monica, both of Calif.

[73] Assignee: PEBD Ltd., Las Vegas, Nev.

[21] Appl. No.: 599,257

[22] Filed: Feb. 9, 1996

[51] Int. Cl.[6] ..... A63B 21/02

[52] U.S. Cl. ..... 482/123; 482/121; 482/126; 482/142

[58] Field of Search ..... 482/121–123, 482/130, 132, 133, 134, 142, 148, 126, 129; 601/23; 472/127, 134, 135

[56] References Cited

U.S. PATENT DOCUMENTS

| | | | |
|---|---|---|---|
| 3,636,946 | 1/1972 | Hardy . | |
| 4,021,035 | 5/1977 | O'Hara . | |
| 4,245,840 | 1/1981 | Van Housen . | |
| 4,268,031 | 5/1981 | Schomberg . | |
| 4,403,773 | 9/1983 | Swann | 482/130 |
| 4,505,474 | 3/1985 | Mattox . | |
| 4,784,386 | 11/1988 | Muehl . | |
| 4,944,518 | 7/1990 | Flynn | 482/129 |
| 4,949,955 | 8/1990 | Keen | 482/93 |
| 4,953,857 | 9/1990 | Lemire | 482/142 |
| 5,112,287 | 5/1992 | Brewer | 482/130 |
| 5,176,706 | 1/1993 | Lee . | |
| 5,242,348 | 9/1993 | Bates . | |
| 5,484,366 | 1/1996 | Wilkinson . | |
| 5,536,228 | 7/1996 | Tanner, Jr. | 482/130 |

OTHER PUBLICATIONS

Schmoll's–Gymnastikgerate, unknown source, Jan. 1979.
Abilitations Spring 1995 catalog, Ballbowl, p. 6, 1995.
Flaghouse, Inc. Spring 1995 catalog, Therapeutic Ball Exercise Cards, p. 8, 1995.
Carriere, Beate, Swiss Ball Exercises, 1991.

*Primary Examiner*—Richard J. Apley
*Assistant Examiner*—Victor K. Hwang
*Attorney, Agent, or Firm*—Fulwider Patton Lee & Utecht, LLP

[57] ABSTRACT

An exercise apparatus has a base having a concave recess in its top surface adapted to receive a resilient ball and at least one attachment point for removably attaching an elastic band. The elastic band has a handhold attached to its end that can be grasped by a user to perform a desired exercise regimen.

7 Claims, 5 Drawing Sheets

FIG. 1
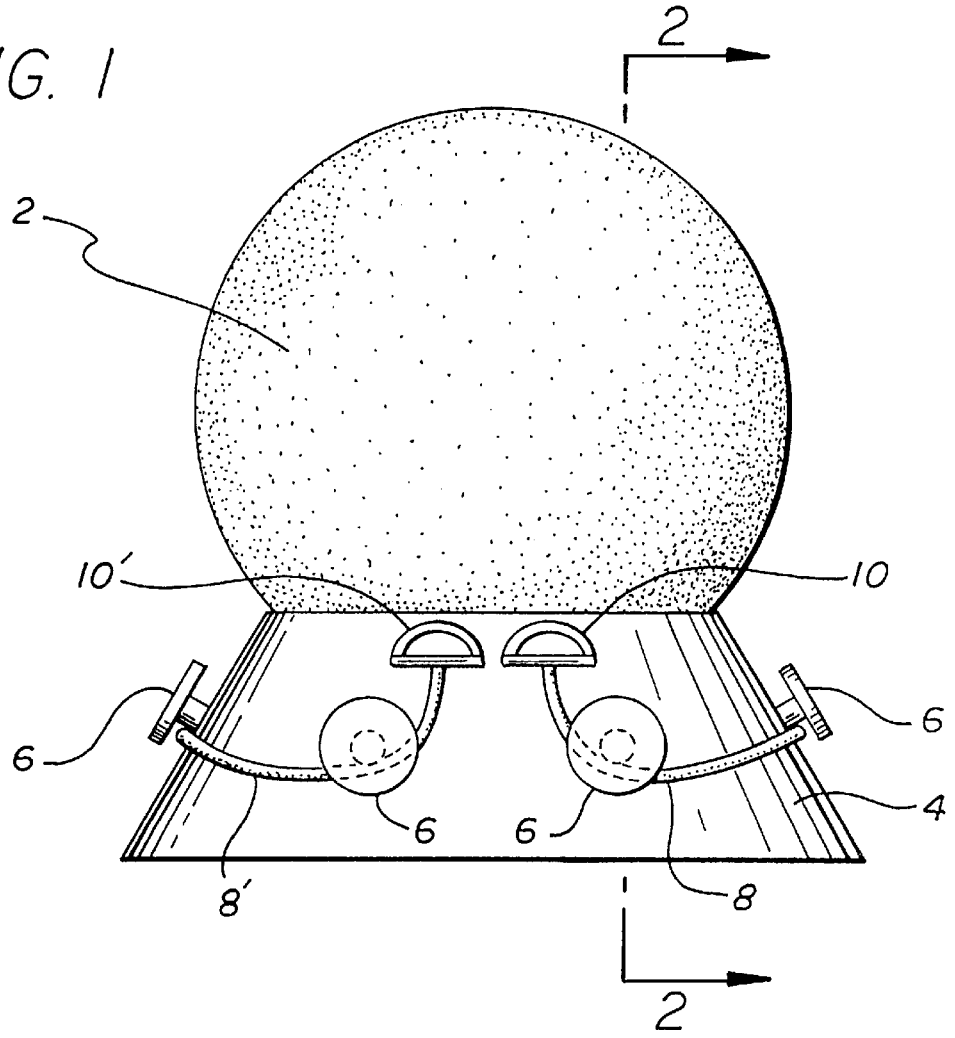
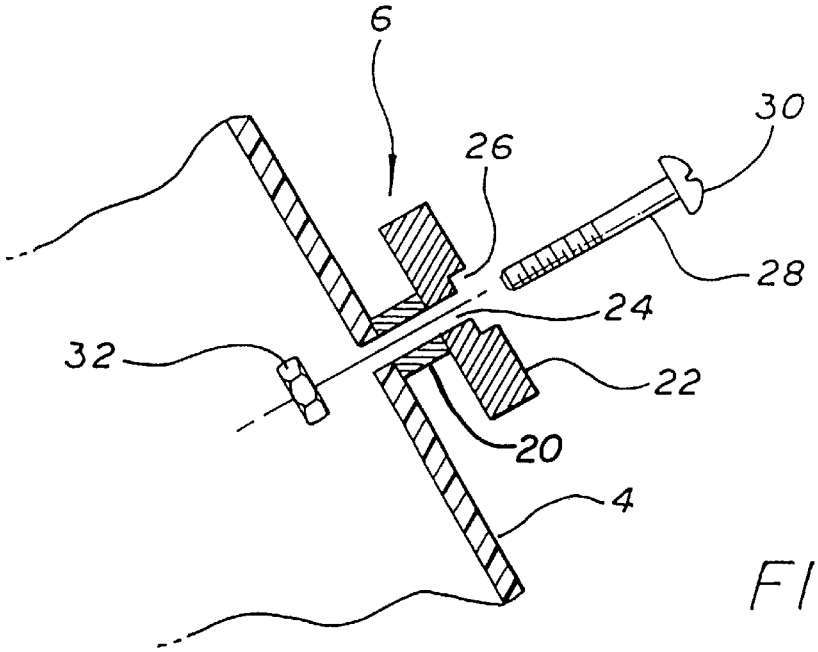
FIG. 2

FIG. 3A
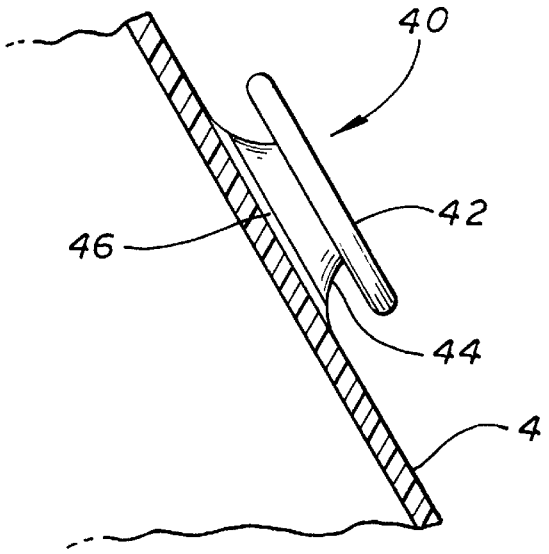
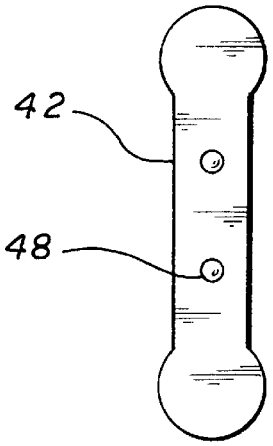
FIG. 3B
FIG. 4
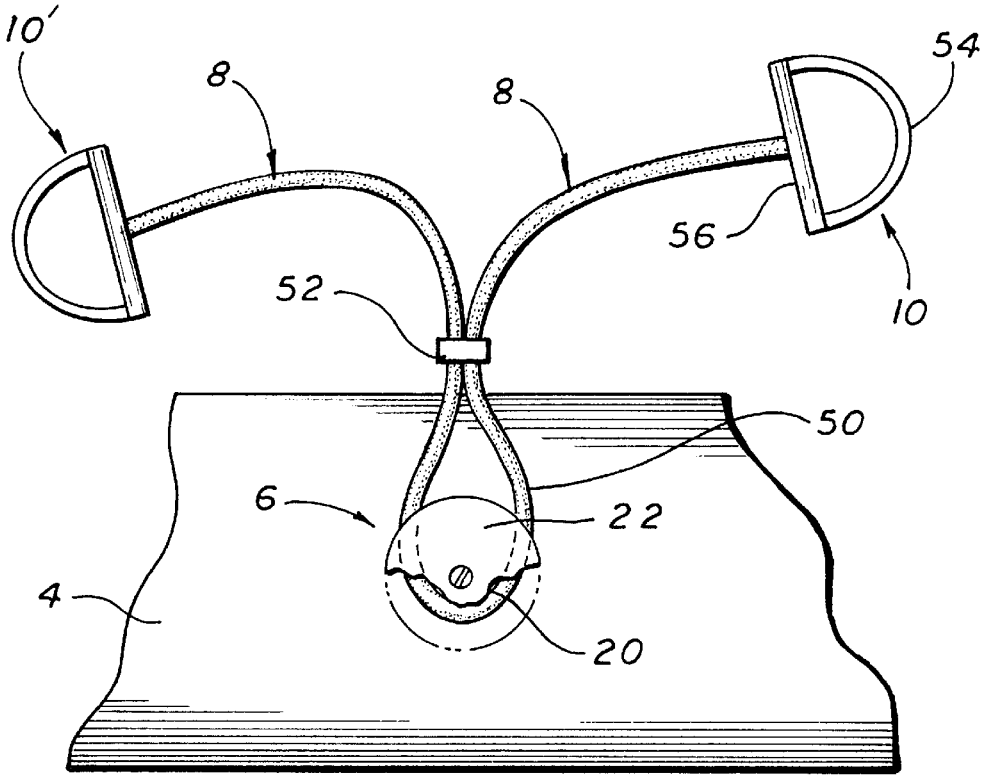

FIG. 8A
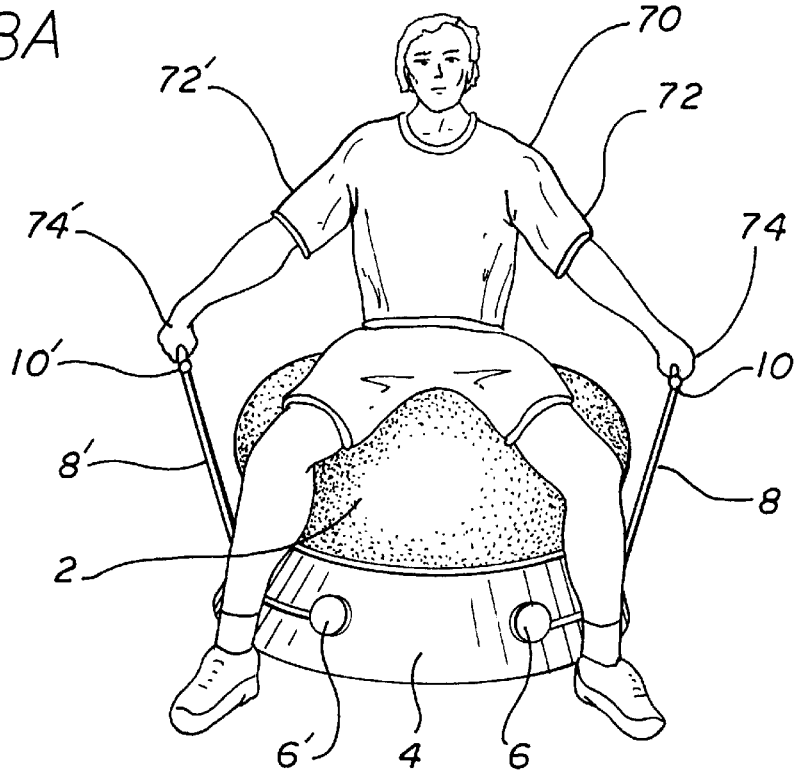
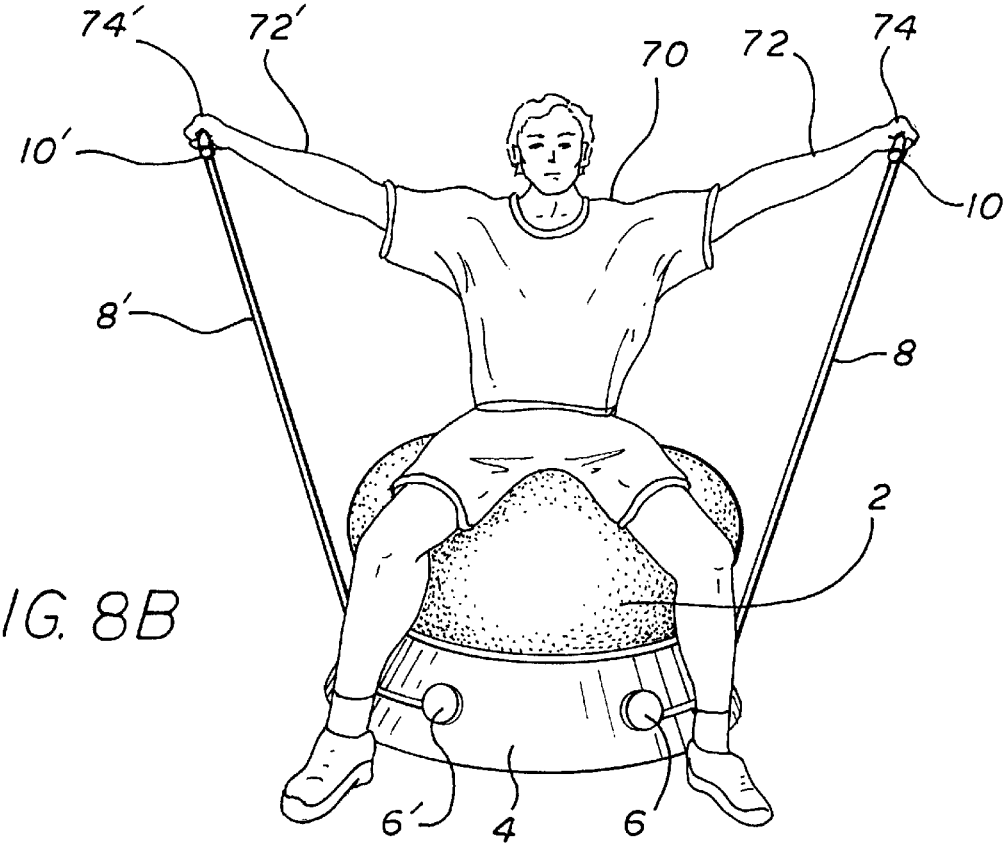
FIG. 8B

APPARATUS AND METHOD FOR EXERCISING

BACKGROUND OF THE INVENTION

1. Field of the Invention

The invention relates generally to exercise equipment which allows a wide variety of exercise regimens and programs to be accomplished for toning the body and increasing strength, endurance and agility without employing harmful impact or stress exercises which damage, tear or pull muscles or cause other muscular-skeletal injury. More particularly, the invention pertains to an apparatus comprising a stable base and retaining a resilient ball, the resilient ball deforming in response to the weight of a user reclining on the ball and to thus support the user's back while performing a variety of stretching or strength building exercises. The base has a plurality of attachment points located around the exterior of the base for attaching and positioning one or more elastic bands. In use, the elastic bands provide the user with a variable resistance during performance of the various exercises to provide an aerobic, isometric or isotonic benefit to the user.

2. Description of the Related Art

Various prior art approaches have been used to design exercise devices which isolate various muscle groups and also provide adjustable resistance. Examples of such apparatus include individual free weights or machines with pulleys and weights, or elastic bands to stress the muscles of the user, thus resulting in improved health, fitness, weight control, muscular tone and size, and coordination.

Exercise devices provide these benefits in a variety of ways. Some exercise devices require repetitive body motion and use pulley or lever assemblies to simulate exercises done with free weights. Others use isometric principles, or utilize resilient devices such as springs or elastic cords. Generally, these devices are designed to promote muscle building and are not designed to be used as part of a universal program by both men and women.

The value of repetitive exercise with a resistive device is well known and health clubs, schools and other recreational organizations have invested heavily in weight lifting equipment, weight training machines, wall mounted weight and pulley exercising devices, as well as a number of other resistive machines and apparatus. The use of such exercising devices not only augments the exercise program of those who engage in regular sports activities, such as running, hand ball, tennis or swimming, but the exercising devices are also used by those who lack the time, space or money to engage in regular sports activities. Another important use of these devices is to provide rehabilitative therapy to individuals who, through injury or disease, have lost muscle strength or function in their torso or one or more limbs.

One problem with all of these exercising devices is that they are often inappropriate for use by a person who has suffered a back injury. It is commonly known that back injuries, even those that are minor and not debilitating in nature, can be aggravated through the use of free weights or exercise machines. During exercise with free weights or exercise machines, the user's spine and the associated ligaments and musculature of the back are unevenly supported due to the unyielding nature of the various weight lifting benches and exercise machines available. Additionally, exercising devices designed to be used in a standing position, or that are used dynamically, requiring motion of the user's body during performance of the exercise, can cause potentially harmful strain of the user's spine and back muscles due to the user's poor posture or lack of coordination during performance of the exercise. This potentially harmful stress or imbalance may result in a new injury, or aggravation of a pre-existing injury.

Physical therapists have utilized an inflatable resilient ball, such as is sold by Sissel, to provide "functional kinetic" therapy while evenly supporting the user's spine and back to prevent injury. The ball has found a special use among physical therapists for rehabilitation of back injuries. When an individual reclines on the ball, the ball deforms in response to the individual's weight and provides equal support to all portions of a person's spine and back musculature. The ball can be employed either statically, i.e. in exercises designed to stretch numerous muscles or muscle groups where the ball remains in one position, or dynamically, where the ball is allowed to roll in conjunction with a user's movements. The shape and resiliency of the ball are particularly useful during dynamic exercise, as the ball automatically changes shape as the user performs the exercise in multiple planes of movement to improve coordination and neuromuscular memory. One exercise program utilizing a resilient ball is described by Beate Carrier in "Swiss Ball Exercises." A variety of exercises are proposed, describing use of a resilient ball to provide static and dynamic stretching to help restore range of movement to post-operative patients, to teach coordination and balance to challenge youngsters and stroke victims, and to condition Olympic skiers and gymnasts.

While the shape and mobility of the ball is advantageous in providing a functional kinetic workout, occasionally, because of specific patient requirements or a lack of balance or coordination, a base to help stabilize the ball during the exercise is required. Additionally, while manipulating the ball itself can provide aerobic, isometric and isotonic exercises, it is also advantageous to provide resistance during the exercise to strengthen muscles in conjunction with use of the ball. To this end, therapists have employed a variety of elastic bands or latex tubing that could be manipulated in a variety of ways to provide resistance training for specific muscles.

Prior art approaches for providing such as a resistance included using a very shallow base to retain the ball in a stable position. Due to its shallow bowl construction, these bases did little to immobilize the ball when any vigorous exercise was attempted. Doughnut-shaped rings were also used to hold the ball in place. These rings were so small that the ball could be easily rolled off the base by a user during all but the least vigorous exercise.

To provide resistance, elastic bands were attached through a large hole in whatever base was being used. In this system, the user's weight on the ball was supposed to trap the base and levers beneath the ball so that the bands could be flexed in a controlled manner. Alternatively, the elastic bands were simply positioned beneath the ball and the user's weight upon the ball was used to keep the elastic bands in position beneath the ball. None of these approaches provided an arrangement enabling the removable attachment of the elastic bands to attachment points disposed around the base ensuring both stable positioning of the ball and retention of the elastic bands.

What has been needed, and heretofore unavailable, is a reliable, low cost, stable base having a plurality of easy to use attachment points for attaching elastic bands in a variety of configurations to provide isolation of various muscle groups and user adjustable resistance to train those muscle groups.

SUMMARY OF THE INVENTION

Briefly and in general terms, the present invention provides a new and improved apparatus and method of operation for providing muscle isolation and resistance training. Basically, the apparatus comprises a base having a plurality of novel attachment points for attaching one or more elastic bands to provide variable resistance in a plurality of movement planes. The attachment points on the base allow for easy attachment or detachment of the elastic bands by a user, and also provide a convenient method of storing the elastic bands when the base is not in use. This construction, in combination with the use of a spherical ball, allows for more stable usage of the apparatus while providing additional support to a user's spine and back musculature to avoid injury.

More specifically, in a presently preferred embodiment, by way of example and not necessarily by way of limitation, the apparatus comprises a sturdy plastic base, sufficiently large in diameter to hold a resilient therapy ball in place within a recessed portion of the base while a user employs the ball during the performance of an exercise regimen. The base prevents the ball from moving during the exercise, ensuring that even a debilitated user, or one who, through age or infirmity lacks the coordination to use the ball safely, can use the ball without danger of losing control of the ball. Additionally, the base includes a plurality of attachment means around which a length of elastic band or latex tubing having handholds for grasping by a user can be looped, thus providing attachment to the base. The elastic band can be attached at one point and then looped around other of the attachment points located around the circumference of the base to adjust the length of the elastic band available to provide resistance during an exercise or to provide a proper arrangement of the handholds of the elastic bands for a variety of exercises.

These and other features and advantages of the invention will become apparent from the following detailed description when taken in conjunction with the accompanied exemplary drawings.

BRIEF DESCRIPTION OF THE DRAWINGS

FIG. 1 is a side elevational view, of an exercise apparatus showing a resilient ball, a base, attachment points, elastic bands and handholds of one embodiment of the present invention.

FIG. 2 is a partial sectional view taken along line 2 of FIG. 1, illustrating the details of one of the attachment points mounted on the base.

FIG. 3A is a sectional view illustrating another embodiment of an attachment point mounted on the base.

FIG. 3B is a top plan view of the attachment point of FIG. 3A.

FIG. 4 is a side elevational view, partially in cutaway, illustrating the elastic band mounted on one of the attachment points of the apparatus of FIG. 1.

FIG. 8A is a front elevational view illustrating use of the embodiment of FIG. 1 to perform a lateral raise exercise showing the user sitting on the ball with the user's arms in an initial, relaxed position.

FIG. 8B is a front elevational view of the exercise depicted in FIG. 8A with the arms of the user raised to extend the elastic bands.

DESCRIPTION OF THE PREFERRED EMBODIMENTS

Figure 5:
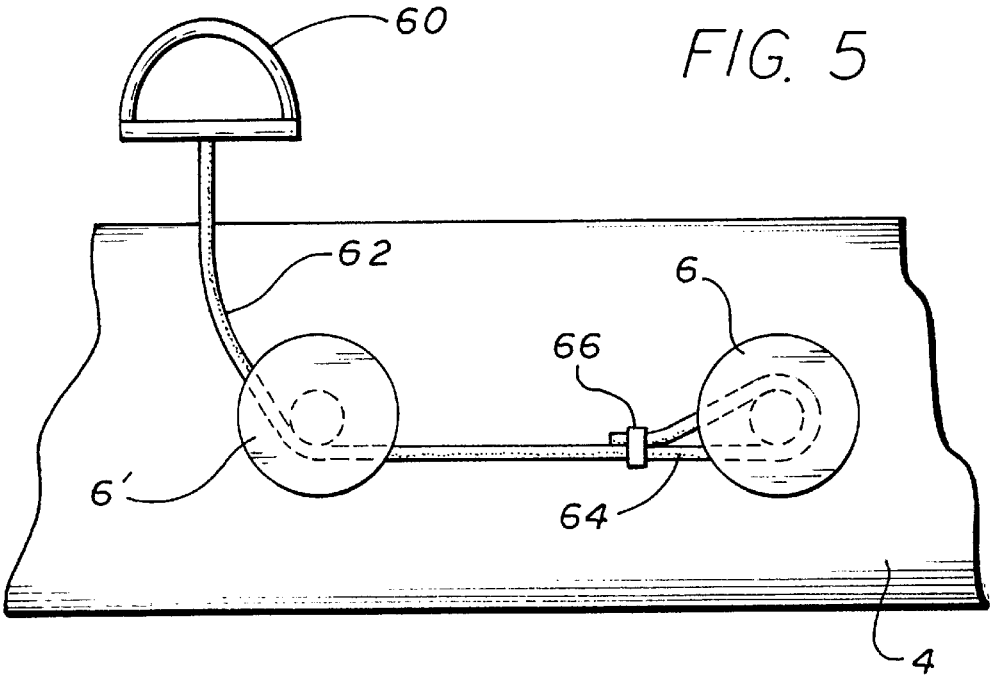
FIG. 5 is a side elevational view, partially in cutaway, illustrating an alternative method of mounting an elastic band to one of the attachment points on the base of the apparatus of FIG. 1, and also depicts how the elastic band can be mounted around another attachment point to adjust the positioning and useful length of the elastic band.

Referring now to the drawings, and more particularly to FIG. 1, there is shown an exercise apparatus generally comprising a resilient ball removably mounted on a base 4. A plurality of attachment points 6 are mounted on the base 4. Elastic bands 8, 8' are attached to or arranged around attachment point 6. The elastic bands have handholds 10, 10' attached to the respective ends of bands 8, 8'. When the handholds 10, 10' are grasped by a user, the handholds 10, 10' allow the user to exercise various muscle groups by first pulling on the handholds 10, 10' elongating elastic bands 8, 8' to provide positive resistance training to a muscle or muscle group, and then relaxing the elastic bands 8, 8' in a controlled manner to provide negative resistance training to the muscle or muscle group. Depending on the exercise to be performed, the elastic bands 8, 8' are arranged around one or more of the attachment points 6 thereby providing the appropriate length and positioning of the elastic bands 8, 8' for the exercise to be performed. The attachment points 6 are disposed around the exterior of the base 4 to allow convenient attachment and routing of the elastic bands 8, 8' so that handholds 10, 10' are in the proper position for carrying out a desired exercise. Thus the handholds 10, 10' may be properly positioned to provide a user with resistance training while seated on the ball 2, lying prone on ball 2 with the user's stomach in contact with the ball 2, or, alternatively, while lying on the ball 2 facing upward so that the ball 2 is in contact with the user's back. Thus, the user's back is supported during performance of the selected exercise.

The ball 2 may be provided in a variety of sizes, depending on age, height or weight of the user and the exercise to be performed. By way of example, and not be way of limitation, a ball having a diameter of 26 inches is commonly used for many exercises. Since the ball is used to support the weight of the user and also to resist the force of the elastic bands 8,8' as they are stretched, the ball should be sufficiently robust so that it does not rupture during use. Accordingly, the ball may be manufactured from a variety of materials, depending on the burst strength and resiliency desired. For example, one ball commonly used is manufactured from a plastic material and has a wall thickness sufficient to give a burst strength of 600 pounds per square inch. Other balls having greater burst strengths can be used as appropriate to serve the exercise needs of heavier users, or to prevent rupture of the ball when used in conjunction with the performance of an exceptionally vigorous exercise routine. While the balls commonly used are inflated with air, the ball 2 may be inflated with any gas that provides a light weight, resilient ball capable of deforming in response to a user's weight when the user sits or lies on the ball, thus providing support for the user's spine and back musculature.

The base 4 may be manufactured from a variety of materials in a variety of shapes and sizes. The base 4 has a hollow recess formed in its top surface. This recess is of sufficient depth so that when the ball 2 is placed in the recess, the ball 2 is held in a stable position. This arrangement is advantageous in that the base 4 resists dislodging of the ball 2 during exercise, but the ball is easily removable if the user desires to perform an exercise that requires support of the user's body as the user moves through multiple planes of movement. While the base 4 is depicted as having a circular outer shape, the base 4 may have any outer shape that allows a semi-spherically shaped recess, capable of receiving a spherically shaped object, to be formed in the top surface of the base 4.

Referring now to FIG. 2, the attachment point 6 is shown as a cylindrical spacer 20 on which is mounted an overhang member 22 whose diameter is sufficiently greater than the diameter of the spacer 20 to provide a retaining area between the exposed portion of the bottom face of the overhang member 22 and the base 4. The overhang member 22 and spacer 20 are assembled together and held in place on base 4 with a threaded screw 28 and nut 32. The top face of the overhang member 22 may have a relief 26 so that the head 30 of threaded screw 28 lies flush or below surface of the top face of the overhang member 22 when the attachment point 6 is mounted on base 4. It should be understood that while attachment point 6 is depicted having a separate cylindrical spacer 20 and overhang member 22 held together by threaded screw 28 and nut 32 when the overhang member 22 is mounted on the base 4, the attachment point 6 could be constructed in such a manner that overhang member 22 is permanently affixed to spacer 20 using a suitable adhesive. In still another embodiment, attachment point 6 could be manufactured from a single piece of a material such as plastic or aluminum. One skilled in the art will also quickly understand that means, other than the threaded screw 28 and nut 32, such as a rivet or a suitable adhesive, can be employed to mount attachment point 6 to the base 4. The attachment points 6 are preferably evenly disposed around the perimeter of the exterior side of the base 4, although uneven spacing to provide for specific configurations of the elastic bands 8, 8' and handholds 10, 10' are also possible.

Referring now to FIGS. 3A and 3B, another embodiment 40 of the attachment point 6 is illustrated. In this embodiment, the overhang member 42 is formed in a "dog bone" shape, the ends of which extend beyond the circumference of the spacer 44 to provide a space for retaining the elastic band 8 in position on the base 4. As previously described, the overhang member 42 and spacer 44 may be manufactured as separate pieces of plastic or some other suitable material such as aluminum or steel, and held in place using screws, rivets 48 or adhesive 46. It is also not necessary for the overhang member 42 to have two ends. An overhang member 42 having a single end or hook shaped member will suffice to hold the elastic band 8 in position. Alternatively, attachment point 40 may be manufactured from a single piece of plastic or other suitable material, and attached to base 4 using either screws, rivets 48 or a suitable adhesive.

Referring now to FIG. 4, one embodiment of the attachment point 6 is depicted in partial cutaway to illustrate the mounting of the elastic band 8 to the base 4. In this embodiment, a single continuous elastic band 8 has handholds 10, 10' attached at both ends. The elastic band 8 is doubled over at a point approximately equi-distant from the ends of the elastic band 8, forming a loop 50. A clamp 52, formed from tape, string, metal or plastic, such as, for example, a plastic cable tie, is affixed around the overlapping portions of the elastic band 8 and tightened sufficiently to prevent the elastic band 8 from slipping and closing the loop 50. The elastic band 8 is then mounted on attachment point 6 by stretching the loop 50 sufficiently so that the loop 50 passes over the overhang member 22 of attachment point 6. Once the loop 50 is passed over the overhang member 22 so that the elastic band 8 encircles the central spacer 20, the loop 50 is allowed to regain its relaxed state, maintaining the loop 50 on the attachment point 6 between the exposed bottom face of the overhang member 22 and the base 4. Preferably, loop 50 is sized so that the diameter of loop 50 is smaller than the diameter of the overhang member 20 of the attachment point 6. In this manner, elastic band 8 is now firmly, yet removably, mounted on the base 4. Alternatively, loop 50 could be replaced by a fastener, such as a hook or metal eye that is sized to engage the attachment point 6. Handholds 10, 10' may now be grasped by a user and an exercise performed wherein the elastic bands 8, 8' are repetitively stretched and relaxed by the user to provide a resistance work out to a selected muscle or muscle group.

Handholds 10, 10' may be constructed in a variety of ways. Referring to FIG. 4, handhold 10 may be formed of two pieces, for example, the ends of a strap 54, formed from leather, cloth, plastic or other suitable material is attached to the ends of a spreader 56. The spreader 56 may be formed from any rigid or semi-rigid material capable of maintaining the shape of the handhold 10 so that the handhold 10 can be safely and comfortably grasped by the user during performance of an exercise. Alternatively, as shown in FIG. 5, handhold 60 may be formed from a single piece of plastic or other rigid, non-deformable material. It will be obvious to one skilled in the art that handhold 60 may be covered with a shock absorbing and/or absorbent material such as rubber or cloth tape to provide a more comfortable, non-slip gripping surface. This is especially useful when sweat forms on a user's hands during vigorous or prolonged exercise.

Referring again to FIG. 5, another embodiment of an elastic band is shown. In this embodiment, elastic band 62 has a handhold 60 attached at one end, and the opposite end is formed into a loop 64 that is then affixed to the body of elastic band 62 by splicing to the band, using a suitable adhesive or with a fastener 66. Alternatively, the loop 64 could be formed with a metal or plastic hook or eye. Elastic band 62 is shown mounted on attachment point 6 and then routed in such a manner that it passes under attachment point 6' thus providing for alternative positioning of the handhold 60 to suit the needs or requirements of a particular exercise. It should be obvious that the invention is not limited to routing elastic band 62 over a single attachment point 6', but that elastic band 62 may be routed over more than one attachment point 6' as required by an exercise. In this manner, elastic band 62 and handhold 60 may also be wrapped around the base 4 and multiple attachment points 6 and 6' in a neat and tidy manner for storage. As should be obvious, where an exercise is to be performed with both hands, thus requiring two handholds 60, a second elastic band 62, handhold 60, and loop 64 assembly can be mounted on the base 4 at the appropriate attachment point 6 to accommodate the user's second hand.

Use of the exercise apparatus illustrated in FIGS. 1 through 5 will now be described. The description of these various exercises are by way of example only; other exercises, or variations of the described exercises are possible. Various routing of the elastic bands and different user positions are also possible. For convenience, like features of the figures are identified using the same reference numbers.

It should be understood that the exercises depicted in FIGS. 6–8B are just a few of the many exercises possible using the present invention.

Figure 6:
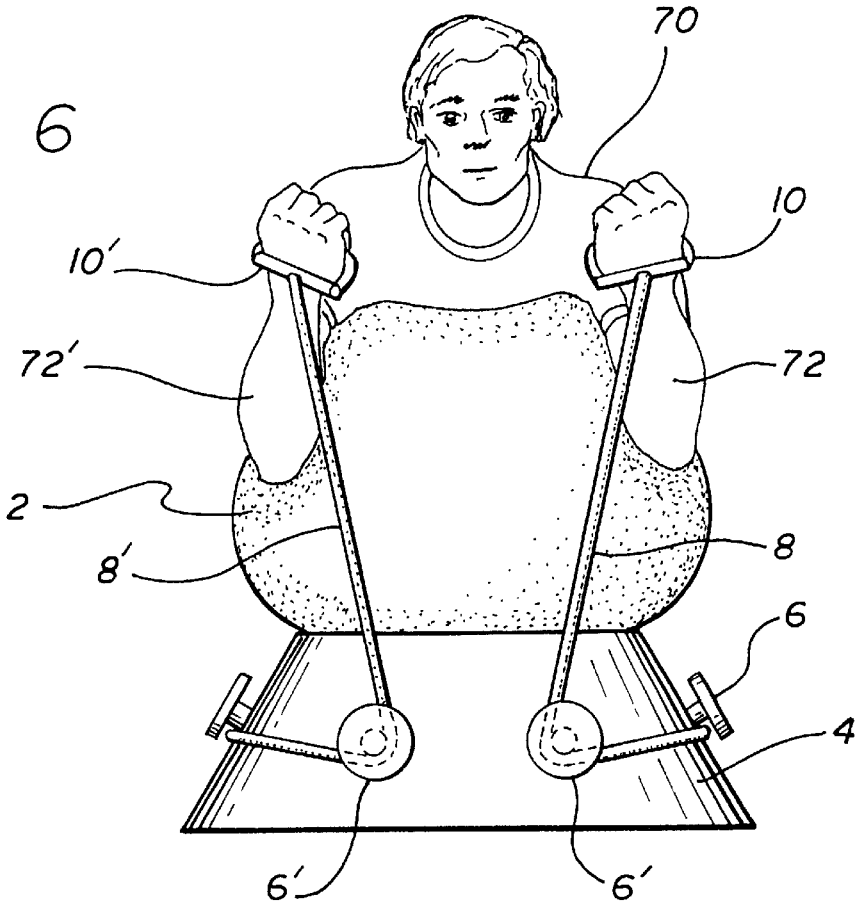
FIG. 6 is a front elevational view illustrating use of the embodiment of FIG. 1 to perform a biceps curl, and depicting the arrangement of the elastic bands on the attachment points of the base to perform this excercise.

Referring now to FIG. 6, a biceps curl exercise designed to strengthen the biceps of the arm is depicted. To perform this exercise, the ball 2 is placed into the base 4 and the elastic bands 8, 8' are attached to and routed around the attachment points 6 as required to perform the desired exercise. The user 70 positions himself in a kneeling or sitting position such that the front portion of the user's body, in most cases, the user's chest and stomach regions, are in contact with the ball 2. The elastic bands 8, 8' are arranged so that they are mounted on the attachment points 6' located on the side of the base 4 opposite from the side of the base 4 adjacent to the user 70, so that the ball 2 is between the user's 70 body and the handholds 10, 10'. The user 70 places his arms 72 on the top surface of the ball 2, and grasps the handholds 10, 10' with each hand. The user 70 then repetitively flexes each arm 72, 72', either in unison or separately to provide resistive training to strengthen the biceps muscles of the user's arms 72, 72'. As the user 70 flexes his arms 72, 72', the elastic bands 8, 8' stretch in response. As the elastic bands 8, 8' stretch, the resistance of the bands increases, thus requiring additional exertion by the user 70 to overcome the increased resistance of the elastic bands 8, 8'. Having flexed his arms 72, 72' as much as possible, the user 70 then relaxes the muscles of his arms 72, 72', slowly extending the arms 72, 72' either in unison or singly, providing negative resistance to the muscles of the arms 72, 72' until the elastic bands 8, 8' have regained their relaxed, non-stretched state, completing one repetition of the exercise. This flexion and extension is repeated as many times as the user 70 desires to provide a workout for the selected muscles. It should be noted that the user's 70 torso is balanced and supported by the ball 2, thus assisting in preventing undue strain to the spine, ligaments, and musculature of the user's 70 back during performance of the exercise.

Figure 7A:
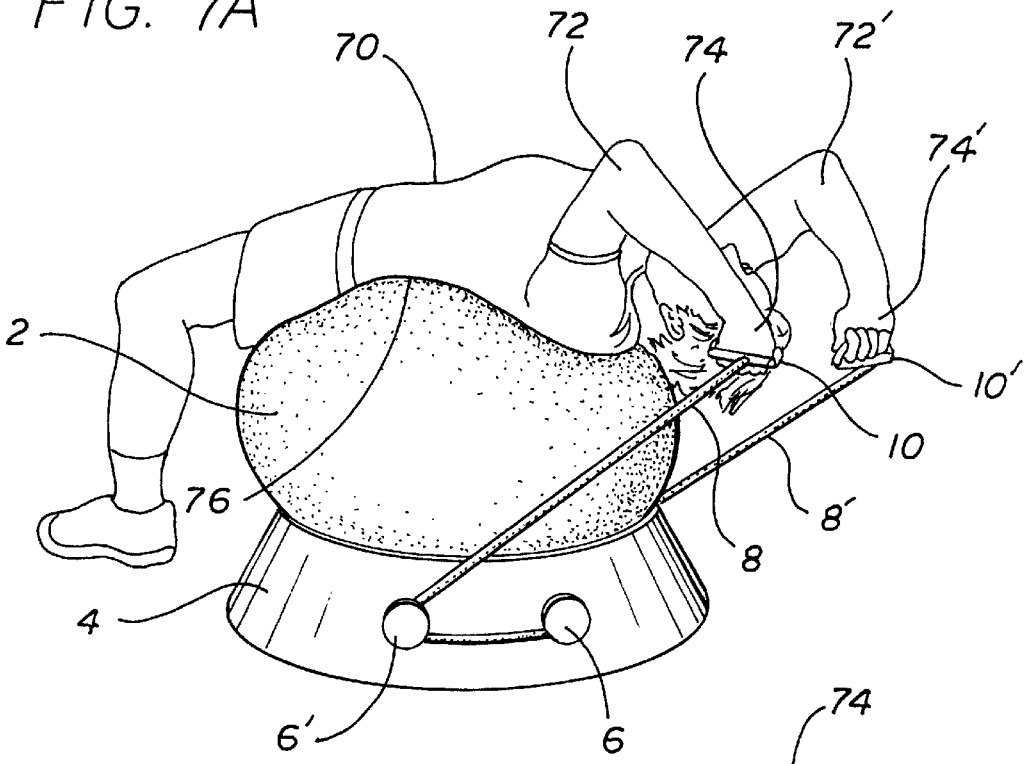
FIG. 7A is a side elevational view illustrating use of the embodiment of FIG. 1 to perform a triceps exercise showing the user lying prone on the ball with the user's back in contact with the ball and with the user's arms in an initial, relaxed position.
Figure 7B:
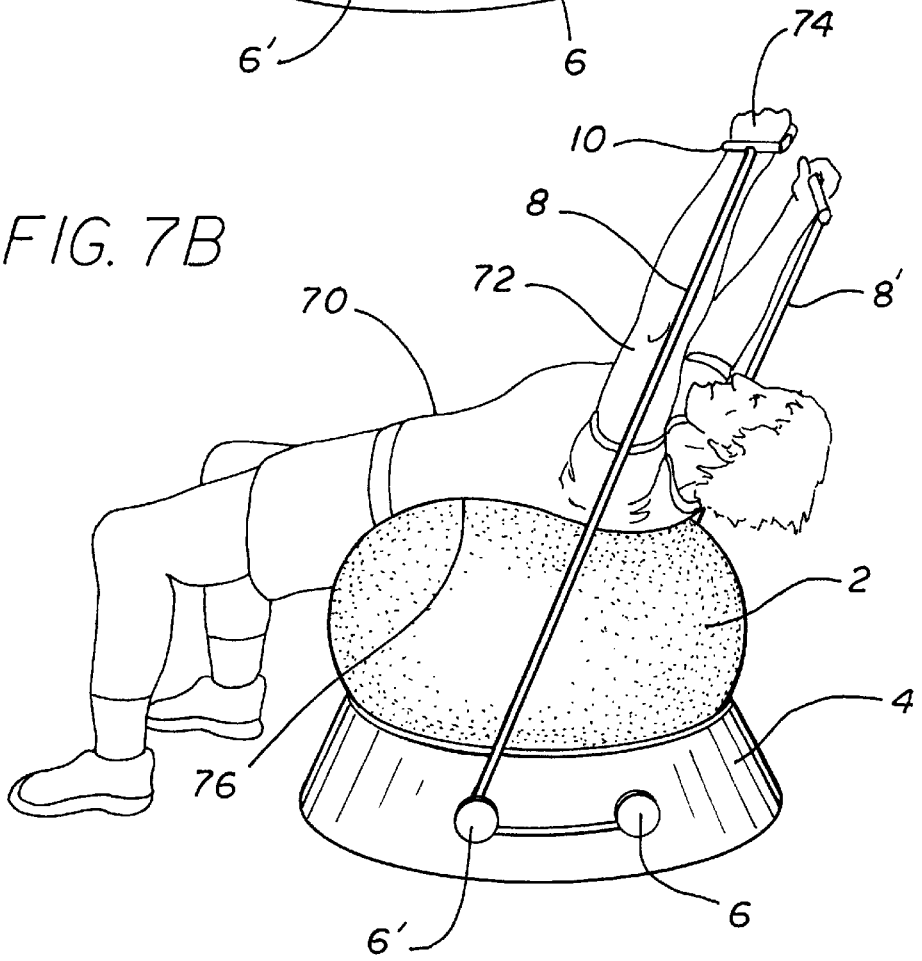
FIG. 7B is a side elevational view of the exercise depicted in FIG. 7A with the arms of the user in an extended position.

Referring now to FIGS. 7A and 7B, a triceps extension exercise is depicted that can be performed while the user 70 lies on the ball 2, thus supporting, as illustrated, the user's spine and back musculature. As depicted in FIG. 7A, the elastic bands 8, 8' are mounted on an attachment point 6' located on the base 4 so that the elastic band 8, 8' is mounted at a position on the base 4 opposite the plane of movement of the user's 70 hands 74. This position results in the elastic band 8, 8' passing diagonally over the ball 2. Mounting the elastic bands 8, 8' to the base 4 at this location illustrates one of the advantages of the present invention in that it allows the user 70 to select approprate attachment points 6, 6' for the elastic bands 8, 8', ensuring that the force of the exercise is evenly transmitted to the ball 2, providing a stable platform for the performance of an exercise by preventing the base 4 from tipping in response to the user 70 extending his arms 72 and maintaining support of the user's 70 back 76 to prevent injury.

As depicted in FIG. 7A, the user 70 grasps the handholds 10, 10' by each hand and then the user extends both arms 72, 72', either uniformly or singly against the resistance of the elastic bands 8, 8', as shown in FIG. 7B. After the arms 72, 72' are extended, the arms 72, 72' are slowly relaxed in a controlled manner to complete one repetition of the exercise. The exercise may be repeated as many times as desired by the user 70.

Referring now to FIGS. 8A and 8B, another exercise using one embodiment of the present invention is illustrated. In this excercise, a lateral raise is performed to benefit the latissmus and triceps muscles. The elastic bands 8, 8' are mounted on the appropriate attachment points 6 to adjust the length of the elastic bands 8, 8' and the position of the handholds 10, 10'. As shown in FIG. 8A, to begin this exercise, the user 70 sits on top of the ball 2 with the ball 2 mounted in base 4, and grasps the handholds 10, 10' with each hand 74, 74'. Keeping the arms forward and straight, the hands 74, 74' are raised to eye level, extending elastic bands 8, 8', as shown in FIG. 8B.

Another advantage of the present invention, as illustrated by the exercise depicted in FIGS. 8A and 8B, is the additional benefit obtained because the user 70 must maintain his balance while seated on top of the ball, thus stimulating various muscles groups in response to changes in the user's 70 balance and posture while performing the exercise, resulting in improved balance and neuro-musculature coordination. This exercise would be difficult to accomplish without the stabilizing effect of the base 4. It should be obvious that lacking the improved stability provided by the the base 4 and attachment point 6 of the present invention, the ball 2 could roll out from under the user, thus possibly causing the user injury. Another advantage over prior art attempts at using elastic bands in conjuction with a ball is that the elastic bands 8, 8', mounted on the base 4, cannot be pulled from under the ball, which often occurs when the elastic bands 8, 8' are merely placed under the ball 2, as is the arrangement previously used.

As will be recognized by those skilled in the art, the present invention has a wide range of applicability and can be modified in many different ways to provide useful exercises for a wide variety of people. The invention is thus applicable in various embodiments to all ages and strengths of people who desire to increase body strength, muscle tone, endurance, balance and coordination. The invention can be configured so that a minimum of strength is required to exercise, or, by appropriately routing elastic bands 8, 8' through multiple attachment point 6, 6', the invention can be adapted to provided a much more vigorous physical workout.

While several forms of the invention have been illustrated and described, it will also be apparent that various modifications can be made without departing from the spirit and scope of the invention. Accordingly, it is not intended that the invention be limited, except by the appended claims.

We claim:

1. An exercise apparatus comprising:

a base having at least one side forming an outer perimeter and a concave upper surface across substantially the entire base configured to receive a deformable exercise ball and to retain the deformable exercise ball on the concave upper surface without deforming the ball;

a reversibly extensible resistance means having a flexible and extensible body portion extending between a first end and a second end; and a plurality of attachment points disposed on the outer perimeter of the base, the attachment points formed to receive the second end of the reversibly extensible resistance means to attach the resistance means to the base at a first location, the attachment points also configured to receive the flexible and extensible body portion of the resistance means, such that the body portion of the resistance means may be maintained at a second location different from the first location.

2. A method of performing exercises by a user comprising:

attaching a first end of an elastic member to a base having a plurality of attachment points formed to receive the first end of the elastic member and also a body portion of the elastic member;

mounting a resilient ball on the base;

positioning a body portion on the ball;

engaging a handhold attached to a second end of the elastic member;

pulling on the handhold to extend the elastic member, wherein an exercise benefit is provided to the user.

3. The method of claim 2, wherein the step of attaching comprises:

forming a loop at the end first end of the elastic member, the loop having a first non-stretched size and a second stretched size; and stretching the loop over an attachment point having a width, such that the stretched size of the loop is greater than the width of the attachment point, and when the loop returns to its first non-stretched size, is retained on the attachment point.

4. The method of claim 2, further comprising the step of mounting the body portion of the elastic member on an attachment point different from the attachment point to which the first end of the elastic member is attached to change the position of the handhold relative to the first end of the elastic member.

5. A system for providing an exercise benefit to a user, the system comprising:

a resilient ball for supporting a user during performance of an exercise;

a base configured to receive the ball;

an elastic member having a first end, a second end and a body portion;

a plurality of attachment means disposed on an exterior side of the base, each of the attachment means formed to receive the first end of the elastic member and the body portion of the elastic member, such that the first end may be removably mounted on a selected one of the plurality of attachment means and the body portion may be mounted on a different selected one of the plurality of attachment means allowing the user to change the position of the second end of the elastic member relative to the position of the first end of the elastic member; and grasping means attached to the second end of the elastic member, wherein the user may perform an exercise by engaging the grasping means and extending the elastic member to provide an exercise benefit to the user.

6. The system of claim 5, wherein the elastic member further comprises:

a loop formed in the body portion, the loop configured to attach to a selected one of the attachment points; and a second grasping means attached to the first end of the elastic member, wherein the user may perform an exercise by engaging the first grasping means and the second grasping means and extending the elastic member to provide an exercise benefit to the user.

7. The system of claim 6, wherein the loop is located between the first end and the second end of the elastic member, dividing the body portion into a first section extending between the loop and the first end and a second section extending between the loop and the second end, wherein the first section may be mounted on a second attachment point and the second section may be mounted on a third attachment point.

* * * * *